United States Patent [19]

Solymos et al.

[11] Patent Number: 4,799,738

[45] Date of Patent: Jan. 24, 1989

[54] MINING METHOD FOR WORKING LARGE-SCALE MINERAL DEPOSITS BY THE CAVING SYSTEM

[75] Inventors: András Solymos; Károly Barsi, both of Tatabánya, Hungary; László Kis-Tamás, Sandal Wakefield, United Kingdom; István Forisek, Tatabánya, Hungary; László Dörömbözi, Tatabánya, Hungary; Ottó Lukonits, Tatabánya, Hungary

[73] Assignee: Tatabányai Szénbányák, Tatabánya, Hungary

[21] Appl. No.: 438,193

[22] Filed: Nov. 1, 1982

[30] Foreign Application Priority Data

Nov. 3, 1981 [HU] Hungary ..... 3276/81

[51] Int. Cl.[4] ..... E21C 41/00

[52] U.S. Cl. ..... 299/11; 299/19; 405/267

[58] Field of Search ..... 299/18, 11, 19; 405/267, 271

[56] References Cited

U.S. PATENT DOCUMENTS

| | | | |
|---|---|---|---|
| 1,004,418 | 9/1911 | Griffith | 299/19 |
| 1,697,788 | 1/1929 | Sinclair | 299/2 |
| 4,174,135 | 11/1979 | Grenia | 299/11 |
| 4,268,088 | 5/1981 | Price | 299/11 |
| 4,340,254 | 7/1982 | Barsi et al. | 299/11 |

FOREIGN PATENT DOCUMENTS

| | | | |
|---|---|---|---|
| 589401 | 4/1978 | U.S.S.R. . | |
| 675186 | 7/1979 | U.S.S.R. | 299/18 |
| 676727 | 7/1979 | U.S.S.R. | 299/18 |
| 0748005 | 7/1980 | U.S.S.R. | 299/19 |
| 754068 | 8/1980 | U.S.S.R. | 299/18 |
| 796425 | 1/1981 | U.S.S.R. | 299/11 |
| 0907273 | 2/1982 | U.S.S.R. | 299/19 |

*Primary Examiner*—Stephen J. Novosad
*Assistant Examiner*—David J. Bagnell
*Attorney, Agent, or Firm*—Schweitzer & Cornman

[57] ABSTRACT

The mining method of this invention is particularly suitable for the underground extraction of large mineral deposits, wherein a subsidiary road is formed perpendicularly to the work face from which the mineral deposit is to be removed. A boundary subsidiary road is formed substantially perpendicularly to the subsidiary road, a first mine tunnel is formed by removing the mineral deposit from the work face along the subsidiary road until the boundary gate road is reached. Then the material around said first mine tunnel is collapsed to fill the same along the subsidiary road and the collapsed matter is consolidated along the subsidiary road. Finally a second mine tunnel is formed along the subsidiary road. The second mine tunnel can be horizontally or vertically adjacent to the first mine tunnel.

7 Claims, 3 Drawing Sheets

MINING METHOD FOR WORKING LARGE-SCALE MINERAL DEPOSITS BY THE CAVING SYSTEM

BACKGROUND

The invention concerns a mining method, especially for the recovery of useful minerals such as coal, bauxite, etc., from large-mineral deposits, utilizing a caving system of high output, increased concentration of production, and increased safety.

A general requirement of increasing importance in mining is maximising the purity and concentration of the mineral and its output. Thus, mining at reduced production costs without leading to a deterioration of the recovery conditions such as of labour safety and reliability of operation are important goals.

These goals come increasingly into force in the recovery of useful minerals occurring in large deposits in several sections lying side-by-side and/or in several layers. Among such minerals is coal, which is of ever greater importance as an energy carrier.

Large mineral deposits make mass production of great concentration possible. However, in the long term this result can be attained for the most complete possible extraction, that is total working, of the mineral deposits only where the yield of the individual sections and layers is obtained by a modern and suitable mining method, for example mechanical caving and block caving with favourable mining and working conditions and increased safety being guaranteed throughout.

Multi-step exploitation of large-scale mineral deposits conventionally is achieved by leaving behind safety pillars in widths of 100 m or more. The minerals are left in the deposit and then, if necessary, are mined out later or are abandoned in place. This is a particularly prevalent method where the work areas or sections lie side-by-side. On the one hand, these pillars have the task of securing or at least improving the mechanical conditions of working. On the other hand, especially in the case of combustible minerals, the pillars play an important part in the mutual isolation between the individual working areas and sections, as well as in effecting a ventilation seal, whereby the danger and occurrence of endogenous mine fires are considerably reduced.

However, an undoubted disadvantage of mining effected with safety pillars is that the usable mineral in the safety pillar can subsequently only be recovered, if at all, under substantially more difficult conditions and at appreciably greater expense. Where mining takes place in several layers, the mineral cannot safely be recovered. The foregoing not only signifies a great loss of mineral resources, but also is sooner or later detrimental to the conditions of mining the other parts of the mineral deposit.

These conditions arise in all mining methods, i.e., room-and-pillar working, strip working, longwall working, long face working with complex machinery, and also in the case where the usable mineral is won by full-bore (blasting) work; at best, especially in the latter case, the technological and winning disadvantages are less important.

A method is known, for example according to Soviet Pat. No. 589,401, in which an artificial pillar is formed. It is characteristic of this method that it is suitable for exploitation in two layers in the case where a stone band lies between the two seams. The two seams or layers are to be selected so that the stone layer lies between them.

The upper layer is extracted by winning in long strips, the roof is secured by anchoring and then a longwall gallery is driven, from which an artificial pillar is formed up to the top of the deposit. Then the lower layer is won and thereupon an overhead cave-in extending to both layers is initiated.

However, the range of utility of this method is limited. The individual technological steps do not render continuous winning possible and in all cases reduce the working output. The method is also costly, since interim securing operations (anchorings) are required which are expensive and complicated in execution and also make the winning more difficult.

An aim of the invention is the development of a method of mining in which the disadvantages of the known methods are eliminated or reduced and which can be used in a wide range for all mineral deposits, especially for mineral deposits of great extent. The present method seeks to enable the recovery to be advantageously cleaner (purer usable mineral), and the production to be more concentrated, less expensive and of increased yield, labour safety and operational reliability.

SUMMARY

In the method according to the invention this mineral deposit is divided up as necessary, horizontally and/or vertically, into sections and/or layers, along these and along the presence of the mineral deposit secondary roadways and, if desired, boundary roadways (openings) are driven, and the mineral is recovered by the caving system. It is characteristic of this method that at least on one side of the secondary and boundary roadways and/or at the top of the layer or layers following the first layer, a consolidated or strengthened zone is formed in a manner known per se. Expediently the zone is formed by consolidation of broken mineral and possibly by pillars of broken material (hereafter: breakage) or mineral material. The mineral material is recovered by working in an advancing and/or retreating system in one or more sections and/or layers in a manner known per se. The secondary and/or boundary roadways or the individual sections thereof are broken off and abandoned after the mineral material is recovered Conveying the recovered mimeral and ventiliation of the mine are carried out through the open secondary and boundary roadway sections and it is possible to do this through the gallery.

According to a preferred embodiment of the method, one secondary roadway is driven open before the working face, while another is driven following the working face.

According to a further preferred embodiment, the boundary roadway is driven open only on one side, in the direction of the width of the mineral deposit.

A plurality of consolidated caved zones can be established on a longwall face. For the formation of the consolidated zones, waste material from the longwall face can be used as an additive. This waste material can be utilized better if the maximum particle size is kept below 1 mm, suitably 0.4 mm–0.6 mm.

Preferably $CO_2$ gas is employed for the consolidation of the breakage. The consolidated zones are formed up to the roof of the subsidiary road.

In a likewise advantageous manner of performing the method, of this invention, the mineral deposit or seam is recovered in divided layers and/or in layers with block caving.

Preferably, the working of the mine is carried out alternately in divided layers and in block caving; it is advantageous if the first layer is exploited by block caving.

An embodiment is wherein the working of the individual sections is carried out alternately by advancing and retreating working. It is advantageous if in the first section the mineral deposit is recovered by working in an advancing system.

According to a further advantageous embodiment, the section of the previously driven secondary or subsidiary gallery following the working face is abandoned by caving.

Finally, in another preferred embodiment the secondary roadway driven open following the working face is used as conveyor roadway.

BRIEF DESCRIPTION OF THE DRAWINGS

The invention will be described in greater detail by reference to preferred embodiments diagrammatically illustrated in the accompanying drawings, wherein.

Explanation of the various types of lines:

The solid lines designate the seam boundaries, the active (open) secondary and boundary roadway sections, the consolidated zone and the working face; the longer broken lines relate to the secondary and boundary roadways which have been broken down (caved); and the dotted (or shorter broken) lines indicate the further section-slice boundaries and the division of the seam.

Explanation of the numerical designations from 10 to 89:

The first digit of every two-digit number is always the serial number of the section or slice. Of the second digits:

0=section;

1=left-hand side subsidiary gallery (secondary roadway) of a given section, as seen in the Figures;

2=the consolidated zone of the corresponding section;

5=slice of a beam divided into working slices;

6=slice with working by block caving;

7=the consolidated zone of the roof of the corresponding layer or slice.

Other numerical designations:

90=boundary roadway

95=roof.

DETAILED DESCRIPTION

Figure 1:
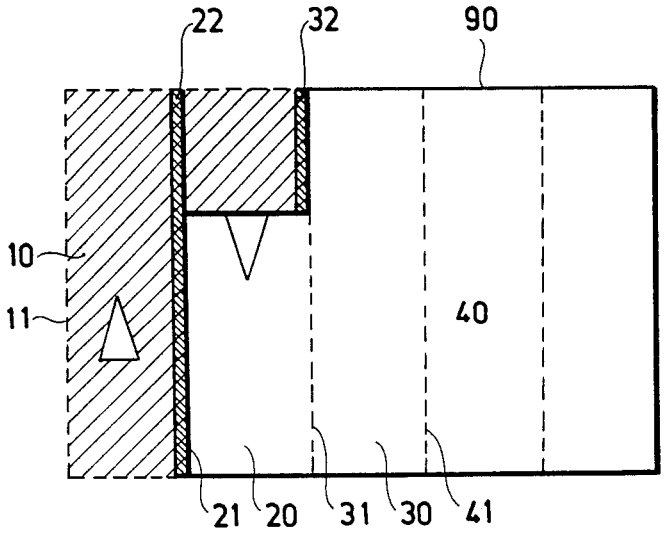
FIG. 1 shows a mineral deposit (slice) divisible into several sections, in plan view, with alternating forward and reverse (advancing and retreating) working, with a consolidated zone without mineral pillars, and with boundary roadways.

Working (mining) in a section 10 according to FIG. 1 is carried out in an advancing system in the course of which secondary (subsidiary) roadways 11, 21 are driven together with the working face. As working progresses the parts lying behind the place of working are (gallery) caved in (light cross hatching) and in the course of this, along the roadway 21 within the section 10 a consolidated zone (heavier cross hatching) is obtained by breakage consolidation. After the working of the section 10 the winning machine is shifted through the boundary roadway 90 into the section 20 and the working is continued in a retreating or reverse system. In the course of this, at the same time as the formation of the working, that section of the secondary roadway 31 which lies behind the working face is also formed, as well as the consolidated zone 32 extending beside the roadway 31 by caving-in behind the gallery. Furthermore the part of the roadway 21 is caved between the working face and the boundary roadway 90. Transport and ventilation take place through the open part of the roadway 21, the work face, the open parts of the roadway 31, this is the secondary transporting roadway), the boundary roadway 90, also by way of the trunk transporting and ventilation roadways (not shown).

Figure 2:
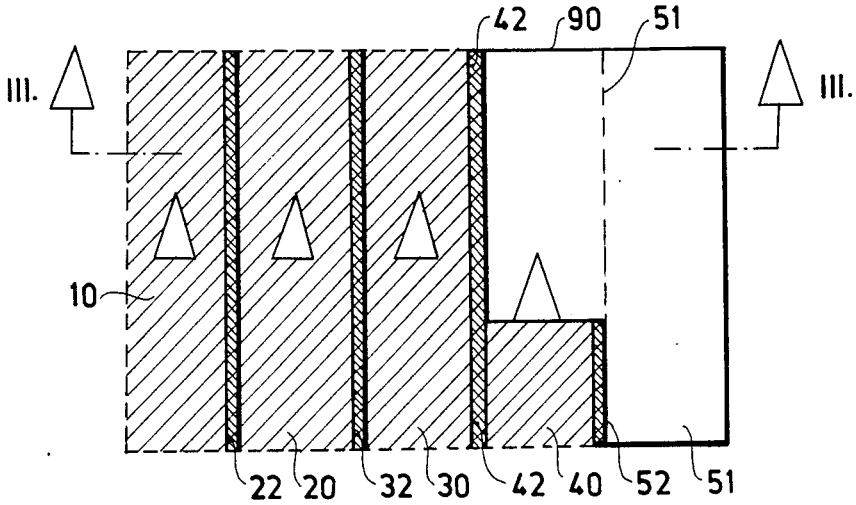
FIG. 2 illustrates the embodiment according to FIG. 1 in plan view, with exclusively advancing working sections.
Figure 3:
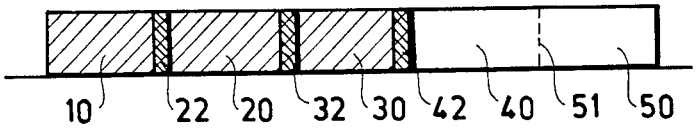
FIG. 3 is a sectional view taken along the plane indicated by lines III—III in FIG. 2.
Figure 4:
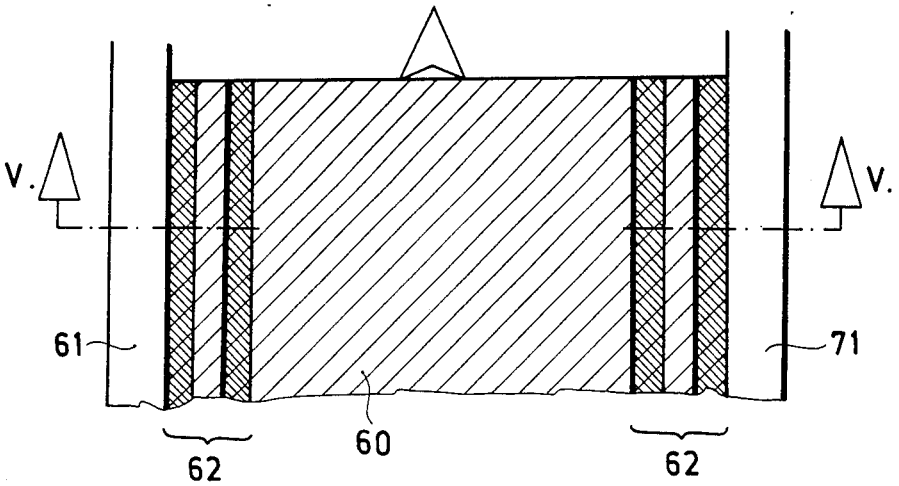
FIG. 4 shows the forward working of a single section with the consolidated zones lying beside the subsidiary galleries within the section, in plan view.
Figure 5:
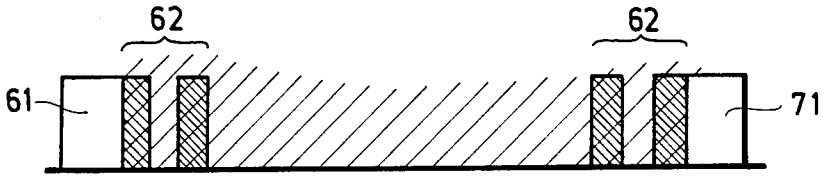
FIG. 5 is a section taken along the plane indicated by lines V—V in FIG. 4.

FIGS. 2 and 3 show the working, taking place in several sections, of a similar seam in which the working of every section is forward or advancing working. This working method can be advantageous in the working of rising coal seams, especially under watery conditions. (This working method can naturally also be performed in a retreating system of working.) In both cases advantageously the subsidiary conveyor roadway should be a roadway section that is established together with the work face, that is to say, is a roadway section still in a good condition. The disadvantage is that the face equipment has to be transported along a long distance on reinstallation. In a longwall face section 60 according to FIGS. 4 and 5, consolidated ribs or 'tacks' are formed between subsidiary roadways 61, 71 in the waste on each side. The roof is left in a naturally caved state between these consolidated 'tacks', as on the rest of the face.

Figure 6:
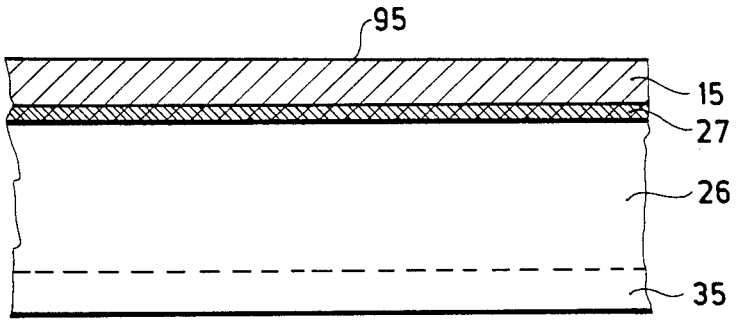
FIG. 6 shows a three-slice working of the seam, in section, where the first slice is a divided slice.

The working of the mineral seam according to FIG. 6 is carried out in three layers or slices. The slice (formed by dividing the seam into slices) below the roof 95 is excavated and broken down (caved in). At the foot of the breakage, a consolidated zone 27 is formed by breakage consolidation, which can expediently be effected in the conventional manner by the supply of $CO_2$ gas to serve as the roof of the slice 26. The load-bearing capacity of this zone is arranged such that it delays the breaking in of the roof of the next succeeding slice 26 securely for the requisite time. Thus the usable mineral of the layer 26 can be extracted by block caving, so that a relatively clean recovery can be realised with minimal working loss. The consolidated zone of appropriate load-bearing capacity to be formed on the floor of the slice 26 makes it possible to work the next succeeding slice 35, formed as a divided slice, under a consolidated roof.

Figure 7:
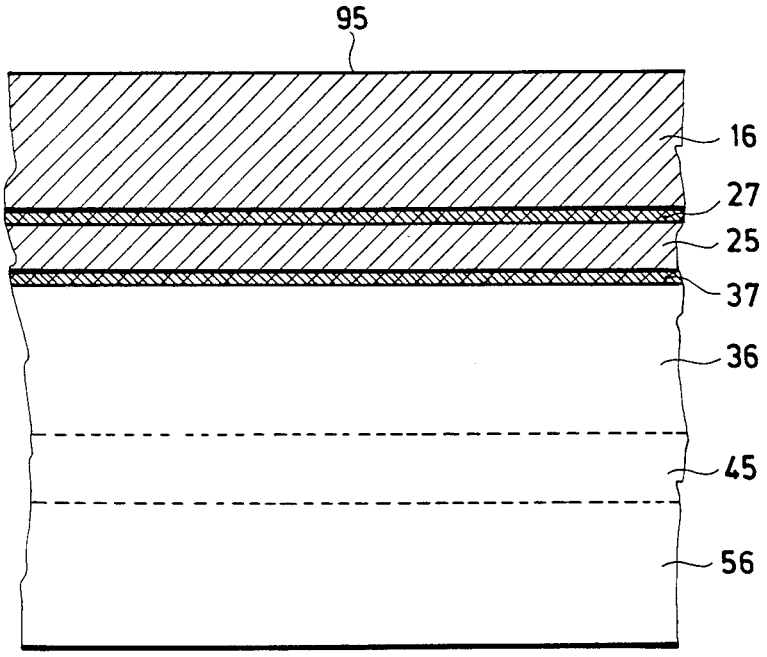
FIG. 7 is a sectional view of working of a thicker seam which can be worked in several slices, where the first slice is excavated with block caving.

In FIG. 7 there is illustrated the extraction in accordance with the invention of a very thick mineral seam which therefore can be worked in substantially more slices than in the above case. In this case the first slice 16 is extracted by sublevel caving (shrinkage). The caved waste is consolidated to form the roof of the slice below 27. The next slice 25 is taken by conventional methods and the caving is again consolidated 37, to form the roof of the next slice 36, which is again extracted by sublevel caving.

Of the advantages connected with the method in accordance with the invention the following should be emphasized especially:

(1) The method can be used in mining by a caving system of all minerals irrespective of the extent of the mineral seam, and offers an especially advantageous recovery method in the working of large or very large mineral deposits.

(2) The consolidated zones make it possible to isolate the broken ores (which may be inflammable) of the individual sections and layers from one another and from the usable mineral deposits not yet involved in the mining. At the same time the consolidated zones—that is, those playing an active part in the taking up of the pressure—have the effect that a lower pressure acts upon the subsidiary and/or boundary roadways, which offers significant advantages in the dimensioning, securing and maintenance of the roadways. In the case of multi-slice working the securing of the roofs of the individual slices by consolidated zones enables one to use safer, cleaner methods involving less loss (shrinkage).

(3) With regard both to the economy of the resources of the earth and to the desirability of continuous and safe extraction, it is of very great importance that the formation and use of consolidated zones permits a substantial reduction of size, and furthermore, in many cases the elimination, of the otherwise necessary separating pillars.

(4) An additional advantage involved with the consolidated zones consists in that more favourable conditions of rock mechanics (pressure wave repulsion or deflection) are brought about by their use in the subsidiary roadways and also in the gallery.

(5) A sequence of the mining of the successive sections and/or layers can be developed which is optimally adapted to the particular nature of the mineral, the dimensions and arrangement of the mineral seam and the geological circumstances.

(6) Additionally, it is possible to design and carry out continuously a production system of great concentration and capacity, without incurring a rise in costs and without detriment to safety. On the contrary, a fundamental feature of the method consists in a more modern and safer extraction with lower production and operating costs.

Further pertinent essential elements are:

Substantially fewer preparatory roadways have to be driven open and maintained; the time required for readjusting, assembling and dismantling the mining and conveying equipment is reduced; as a result of the shorter open roadway length less mechanical equipment is necessary for the conveying of the materials and minerals; more modern ventilation can be ensured.

We claim:

1. A mining method for the underground extraction of large mineral deposits, comprising:

(a) forming a subsidiary road perpendicularly to the work face from which the mineral deposit is to be removed;

(b) forming a boundary road substantially perpendicular to said subsidiary road;

(c) forming a first mine tunnel by removing the mineral deposit from said work face, along said subsidiary road until said boundary road;

(d) collapsing the material around said first mine tunnel to fill the same along said subsidiary road;

(e) consolidating the collapsed matter along said subsidiary road; and (f) forming a second mine tunnel along said subsidiary road.

2. The mining method of claim 1, wherein said second mine tunnel is substantially horizontally or substantially vertically disposed relative to said first mine tunnel.

3. The process of claim 2, wherein the mineral is extracted by descending slices.

4. The method of claim 1, wherein waste material from the work face is used as an additive for the consolidation of the caving.

5. The process of claim 4, wherein the waste material used for the consolidation is previously ground to a particle size of less than 1 mm.

6. The method of claim 4, wherein the waste material used for the consolidation is previously ground to a particle size of from 0.5 mm to 0.6 mm.

7. The method of claim 1, wherein the mineral is extracted by sublevel caving.

* * * * *